US005803179A

United States Patent [19]

Echols et al.

[11] Patent Number: 5,803,179

[45] Date of Patent: Sep. 8, 1998

[54] SCREENED WELL DRAINAGE PIPE STRUCTURE WITH SEALED, VARIABLE LENGTH LABYRINTH INLET FLOW CONTROL APPARATUS

[75] Inventors: Ralph H. Echols; Syed Hamid, both of Dallas; David W. Fish, Carrollton; Rex D. Presley, Ben Wheeler; Timothy E. Harms, The Colony, all of Tex.

[73] Assignee: Halliburton Energy Services, Inc., Dallas, Tex.

[21] Appl. No.: 777,650

[22] Filed: Dec. 31, 1996

[51] Int. Cl.[6] ..... E21B 43/00; E21B 33/12; E21B 17/10; E03B 3/11

[52] U.S. Cl. ..... 166/370; 166/386; 166/50; 166/316; 166/242.1

[58] Field of Search ..... 166/370, 386, 166/50, 227, 316, 242.1, 228

[56] References Cited

U.S. PATENT DOCUMENTS

| | | | |
|---|---|---|---|
| 163,749 | 5/1875 | Danforth . | |
| 1,202,515 | 10/1916 | Hardin et al. . | |
| 1,245,170 | 11/1917 | Andrews . | |
| 1,520,376 | 12/1924 | Verneuil . | |
| 1,594,788 | 8/1926 | McLaughlin et al. . | |
| 1,861,722 | 6/1932 | Searle . | |
| 2,090,180 | 8/1937 | Bryant | 166/5 |
| 2,681,111 | 6/1954 | Thompson | 166/235 |
| 3,095,041 | 6/1963 | Rasmussen | 166/235 |
| 3,937,281 | 2/1976 | Harnsberger | 166/233 |
| 4,629,002 | 12/1986 | Pringle | 166/324 |
| 5,355,956 | 10/1994 | Restarick | 166/296 |
| 5,435,393 | 7/1995 | Brekke et al. | 166/370 |

*Primary Examiner*—Tamara L. Graysay
*Assistant Examiner*—Gary S. Hartmann
*Attorney, Agent, or Firm*—William M. Imwalle; Paul I. Herman; Marlin Smith

[57] ABSTRACT

A drainage pipe section for a horizontal subterranean well has a base pipe coaxially circumscribed by a tubular structure having a longitudinally intermediate portion defined by a sand screen assembly. An annular flow passage is formed between the base pipe and the tubular structure and communicates with the interior of the base pipe via base pipe sidewall openings positioned inwardly adjacent opposite end portions of the tubular structure. Annular adjustable flow control members having variable length labyrinth passages recessed into their outer sides are coaxially interposed in the annular flow passage between the opposite ends of the sand screen assembly and the base pipe sidewall openings. The flow control members are sealed within the annular flow passage by means of a rubber coating adhered to their outer side surfaces, and an adhesive type sealant material injected into annular spaces between the flow control members and facing portions of the base pipe. Specially designed plugs having resilient portions are used to selectively seal off portions of the labyrinth passage to selectively vary its effective length and thus the resistance to flow therethrough and the fluid flow into the base pipe interior through the annular flow passage. Additional seal structures are provided at the opposite ends of the tubular structure, each including a quantity of adhesive type resilient sealant material injected between the tubular structure end portion and the base pipe, and two annular resilient elastomeric backup seals.

48 Claims, 5 Drawing Sheets

SCREENED WELL DRAINAGE PIPE STRUCTURE WITH SEALED, VARIABLE LENGTH LABYRINTH INLET FLOW CONTROL APPARATUS

BACKGROUND OF THE INVENTION

The present invention generally relates to the retrieval of production fluids in subterranean wells and, in a preferred embodiment thereof, more particularly relates to screened or filtered drainage pipe structures used to filter and retrieve production fluids in horizontal subterranean wells.

The elongated horizontal fluid-receiving subterranean piping portion in a horizontal well is typically formed from joined drainage pipe sections. Each drainage pipe section has an external screen or other filter structure thereon for filtering production fluid being forced inwardly through the screen into the interior of drainage pipe section via suitable side wall openings therein. The horizontal piping portion has an upstream end commonly referred to as the "toe" of the overall underground piping structure, and a downstream or "heel" end joined to the vertical piping portion leading to the surface.

A well-known problem in this type of production fluid retrieval system is that the flow rate of fluids produced from a horizontal well is not uniform over the horizontal producing length of the well. Instead, the fluid inflow rate is generally high near the heel compared to the toe due to the inherent pressure drop in the horizontal section of the well bore. This differential production rate, in some instances, could undesirably limit the maximum production fluid drainage that can be achieved for a given reservoir.

One previously proposed method of preventing this undesirable production fluid inflow rate along the heel-to-toe length of the horizontal piping portion of the well is to incorporate adjustable choke structures (commonly referred to as inlet control devices of "ICD's") in the individual drainage pipe sections to control the inflow rate to each drainage pipe section in a manner providing an essentially constant inflow rate profile along the heel-to-toe length of the horizontal piping section. This desirable result may be at least theoretically achieved by setting the chokes to have progressively higher hydraulic resistances from the heel to the toe of the horizontal piping portion of the subterranean well.

While this theoretical approach to equalizing inflow along the horizontal piping length would appear to be a relatively simple and straightforward solution to the nonuniform drainage inflow problem in horizontal wells, actual embodiment of this concept into a practical design in horizontal wells has proven to be surprisingly difficult due in large part to geometrical limitations of the available space in typical horizontal well applications, and due to the tolerances on the pipe diameters requiring highly demanding seal designs in the choke structures.

For example, in one previously proposed type of choke or inlet control device, illustrated and described in U.S. Pat. No. 5,435,393 to Brekke et al, a labyrinth structure having a selectively variable effective flow passage length is interposed between the flow outlet side of the outer filter structure and the inlet openings in the interior base pipe portion of the overall screened drainage pipe section. Thus, during operation of the drainage pipe section, production fluid is sequentially forced inwardly through the filter, through the labyrinth structure, inwardly through the side wall openings in the base pipe, and through the interior of the base pipe to the surface via the balance of the production piping length.

Using, for example, external plug devices removably inserted into various ones of the labyrinth passages as shown in the aforementioned U.S. Pat. No. 5,425,393 to Brekke et al, the effective length and thus flow resistance of the labyrinth may be selectively varied to correspondingly adjust the fluid inflow rate to the interior of the base pipe.

At production fluid pressures typically encountered in horizontal wells, the overall effectiveness and flow control accuracy of this general type of adjustable labyrinth inlet control device tends to be substantially degraded due to the tendency of production fluid to at least partially bypass the labyrinth passageway on its way into the interior of the base pipe through two leakage flow paths.

The first leakage flow path is disposed between the labyrinth structure and the structure which operatively supports it exteriorly on the base pipe. Due to the presence of this first leakage flow path, an often substantial amount of the production fluid inwardly exiting the screen or filter simply bypassed its intended labyrinth passageway and flowed into the base pipe without being subjected to the adjustable flow resistance of the labyrinth. Due to the unavoidably different clearances between the labyrinths and their associated base pipes and support structures, the degree of bypass leakage was a variable factor which to a substantial extent prevented accurate adjustment of each base pipe inflow rate using the labyrinth adjustment structure.

Unlike the first leakage flow path, the second leakage flow path permits the well fluid to bypass the external filter or screen structure, and at least a portion of the intended labyrinth passageway, and flow unfiltered into the interior of the base pipe. A portion of this second leakage flow path can occur at the external plug devices extending through the labyrinth structure into various ones of its internal flow passages. Pressurized unfiltered production fluid tends to leak inwardly through these plug devices into their associated labyrinth passages, thereby undesirably bypassing a portion of the intended labyrinth flow length and altering its otherwise predictable effect on the production fluid inflow rate to the base pipe. An additional portion of this second leakage flow path can occur between the labyrinth and its supporting structure, at the outlet end of the labyrinth structure, and undesirably permit unfiltered production fluid to enter the base pipe without operatively traversing the labyrinth as intended.

As can readily be seen from the foregoing, it would be highly desirable to provide, in a screened or otherwise filtered well drainage pipe section, improved adjustable labyrinth type inlet flow control apparatus, and associated methods, in which the above-mentioned problems, limitations and disadvantages of conventional labyrinth type inlet control devices are eliminated or at least substantially reduced. It is accordingly an object of the present invention to provide such improved adjustable labyrinth type inlet flow control apparatus and associated methods.

SUMMARY OF THE INVENTION

In carrying out principles of the present invention, in accordance with a preferred embodiment thereof, a subterranean drainage pipe structure is provided with inlet flow control apparatus which, due to unique sealing techniques incorporated in various locations in the overall drainage pipe structure, provides for enhanced accuracy in regulating the well fluid flow into the drainage pipe structure. Thus, when a series of the drainage structures are joined end-to-end in the horizontal portion of a subterranean well the production fluid retrieval rate may be more precisely equalized along the length of the drainage pipe string, from its toe portion to its heel portion, to thereby more nearly optimize the well production rate.

Each drainage pipe structure representatively comprises a tubular base pipe having, in opposite end portions thereof, at least one sidewall fluid inlet opening. A tubular structure coaxially circumscribes the base pipe and forms therewith an annular flow passage that surrounds the base pipe and communicates with the interior of the base pipe via its sidewall inlet openings. A longitudinally central portion of the tubular structure is defined by a fluid filtering apparatus, preferably a tubular sand screen assembly, The outer ends of the sand screen are positioned axially inwardly of the base pipe sidewall openings, and opposite outer end portions of the tubular structure are positioned axially outwardly of the base pipe sidewall openings.

Coaxially interposed in opposite end portions of the annular flow passage, between the opposite ends of the sand screen assembly and the base pipe sidewall inlet openings, are a pair of annular flow control members each having inner and outer side surfaces and a fluid flow passage axially traversing the flow control member. Accordingly, pressurized well fluid passing inwardly through the sand screen assembly into the underlying annular flow passage then sequentially flows through the flow control member passages, through remaining portions of the annular flow passage between the base pipe and the tubular structure, and into the interior of the base pipe via its sidewall inlet openings.

Preferably, the fluid passage in each flow control member is a labyrinth flow passage recessed into its outer side surface and having an inlet portion extending into the flow control member end facing the sand screen assembly, a main labyrinth portion extending circumferentially around the flow control member, and a circumferentially spaced series of outlet portions extending from the main labyrinth portion outwardly through the flow control member end facing away from the sand screen assembly.

The flow rate through each flow control member, and thus the well fluid flow rate into its associated base pipe, is selectively regulated by selectively varying the effective fluid flow length of its labyrinth flow passage. In the preferred embodiment of the present invention, this is achieved using specially designed first and second plug structures each of which has a resilient portion that operates to sealingly block off selected ones of the labyrinth passage outlet portions, while leaving a selected one of the outlet passage portions unblocked. Each plug structure has associated therewith one of a circumferentially spaced series of internally threaded circular holes that are formed through the tubular structure in alignment with the underlying labyrinth flow passage outlet portions.

Each first plug structure has (1) a resilient portion having a first section receivable in one of the labyrinth passage outlet portions, and (2) a second section receivable in an inner end portion of the overlying tubular structure openings; and a rigid portion that is threadable into the opening into forcible engagement with the first resilient portion section in a manner deforming the resilient portion into a sealingly blocking relationship with its associated tubular structure opening and its associated labyrinth passage outlet portion.

Each second plug structure has (1) a first rigid portion positionable at the inner end of its associated tubular structure opening with an inner side thereof resting on flow control member outer side surface ledge portions adjacent thereto, (2) a resilient portion secured to the outer side of the rigid portion, and (3) a second rigid portion threadable into the associated tubular structure into forcible engagement with the resilient portion in a manner deforming it into sealingly blocking engagement with the tubular structure opening.

The first and second plug structures, in addition to being operative to selectively vary the well fluid flow through the flow control members, also form part of the improved overall sealing structure of the present invention by functioning to essentially prevent undesirable well fluid inflow through the plug openings which would permit such inflowing well fluid to bypass an intended portion of the intended total labyrinth passage flow length and thereby degrade the regulation accuracy of the flow control portion of the overall drainage pipe structure.

In the preferred embodiment of the present invention, another portion of the improved overall sealing apparatus is positioned at the opposite ends of the tubular structure and functions to essentially prevent well fluid inflow axially inwardly beneath such opposite ends into the annular flow passage, thereby permitting such inflowing well fluid to bypass the annular flow control members and enter the base pipe interior without traversing the intended labyrinth flow passages.

This second portion of the improved sealing apparatus provides redundant nose seals at the opposite ends of the tubular structure coaxially surrounding the base pipe. Each tubular structure end portion, at its outer end, defines an annular gap around the base pipe, such annular gap communicating at its axially inner end with a diametrically enlarged annular interior side surface recess in the tubular structure end portion. A first portion of each redundant nose seal is formed by injecting an adhesive type resilient sealant material into the annular recess, through spaced sidewall openings in the tubular structure, in a manner filling it and forcing a portion of the injected sealant outwardly into the annular gap.

To facilitate the formation of this seal portion, annular exterior side surface recesses are formed in the base pipe in opposing relationships with the outer end portions of the tubular structure. The surfaces of these recesses, and opposing interior side surface portions of the tubular structure have a suitable primer material applied thereto prior to the injection of the adhesive type sealant material. Preferably, the primer material is an epoxy xylene material, and the adhesive sealant material is a chemically curing polythioether polymer-based sealant material.

In addition to the annular resilient seal structure defined by the injected quantity of adhesive type resilient sealant, each redundant nose seal apparatus also preferably includes (1) an elastomeric O-ring seal disposed axially inwardly of the injected sealant and compressed between the tubular structure and the base pipe, and (2) an elastomeric annular lip seal member disposed axially inwardly of the O-ring seal, having a generally C-shaped cross section, and being compressed between the tubular structure and the base pipe.

In the preferred embodiment of the present invention, a third portion of the overall improved seal apparatus is disposed at each of the annular flow control members and serves to essentially prevent any appreciable quantity of pressurized well fluid from axially traversing the flow control member without passing through the entire intended effective length of its labyrinth flow passage. At each annular flow control member such third seal apparatus portion preferably includes (1) a first generally annular seal structure positioned between the outer side surface of the flow control member and the facing interior side surface portion of the tubular structure, and (2) a second generally annular seal structure positioned between the inner side surface of the flow control member and a facing outer side surface portion of the base pipe.

The first generally annular seal structure is representatively formed by a thin elastomeric coating, preferably rubber, adhered to the nonrecessed outer side surface portion of the flow control member and compressed between the flow control member and the facing inner side surface portion of the tubular structure. The compression of this elastomeric coating, and the proper axial positioning of the flow control member within the tubular structure is preferably facilitated by providing each with small complementary conical tapers along their facing side surface portions.

The second generally annular seal structure representatively includes an annular outer side surface recess formed in the base pipe and facing the inner side surface of the annular flow control member. The surface of this recess and the facing inner side surface of the flow control member are coated with a primer material, preferably an epoxy xylene material. Disposed in an axially central portion of this recess is an annulus of adhesive type sealant material which is sealingly adhered to facing primed surface areas of the recess and the inner side surface of the flow control member. The adhesive type sealant material, preferably a chemically curing polythioether polymer-based sealant material, is operatively positioned within the drainage pipe structure by injecting predetermined quantities thereof through circumferentially spaced injection openings extending inwardly through the tubular structure, and underlying openings formed in nonrecessed sidewall portions of the flow control member, into the annular space between the base pipe and the flow control member.

According to another feature of the present invention, the radial alignment of the base pipe and its outwardly circumscribing tubular structure, and thus the thickness uniformity of the various annular spaces within the drainage pipe structure, is facilitated by a centering structure incorporated in the drainage pipe structure. Representatively, such centering structure includes axially spaced apart series of circumferentially spaced internally threaded sidewall openings formed in the tubular structure, and a series of adjustment members threadingly received in the internally threaded sidewall openings and bearing against the base pipe. Preferably, these sidewall openings include circumferentially spaced series thereof extending through opposed outer end portions of the tubular structure, and circumferentially spaced series thereof extending through the tubular structure axially outwardly adjacent the opposite ends of the tubular sand screen assembly.

DETAILED DESCRIPTION

Figure 1:
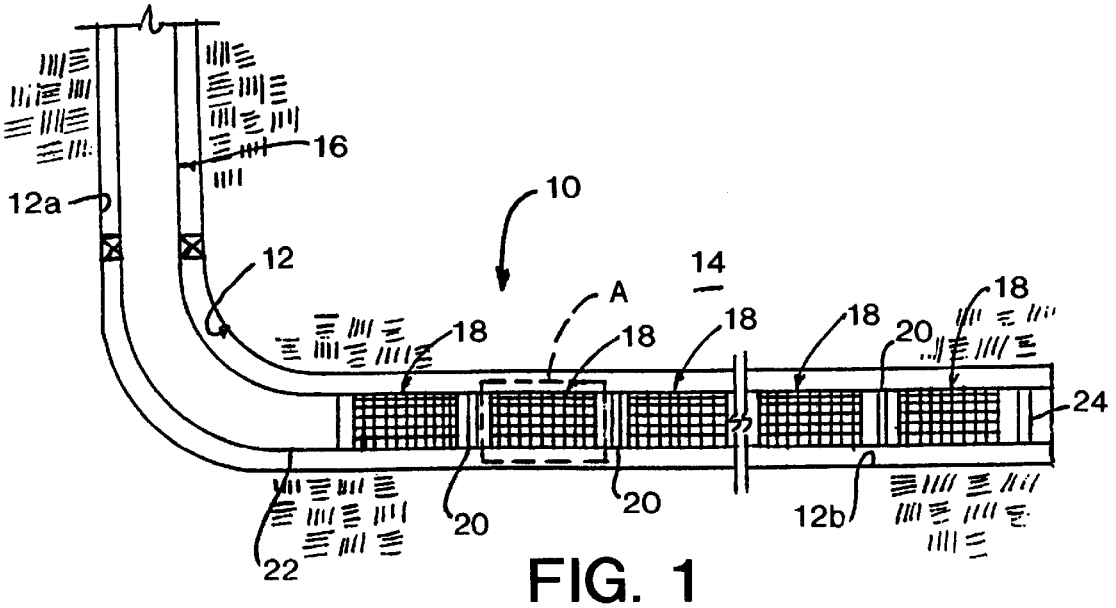
FIG. 1 is a schematic cross-sectional view through a horizontal well illustrating a drainage pipe assembly made up of screened drainage pipe sections incorporating inlet flow control structures embodying principles of the present invention.

Depicted in highly schematic form in FIG. 1 is a portion of a horizontal subterranean well 10 having a wellbore 12 formed in the earth 14 and having a generally vertical portion 12*a* leading to the surface, and a generally horizontal portion 12*b* extending through a subterranean well fluid production zone. To retrieve production fluid, such as oil, from the well 10 a production piping string 16 is extended from the surface downwardly through the wellbore 12 and has a horizontal portion disposed in the wellbore section 12*b* and made up of individual drainage pipe sections 18 coaxially joined together by suitable couplings 20. The horizontal portion of the piping string 16 has a "heel" section 22 and a "toe" section 24 as indicated in FIG. 1.

Figure 2:
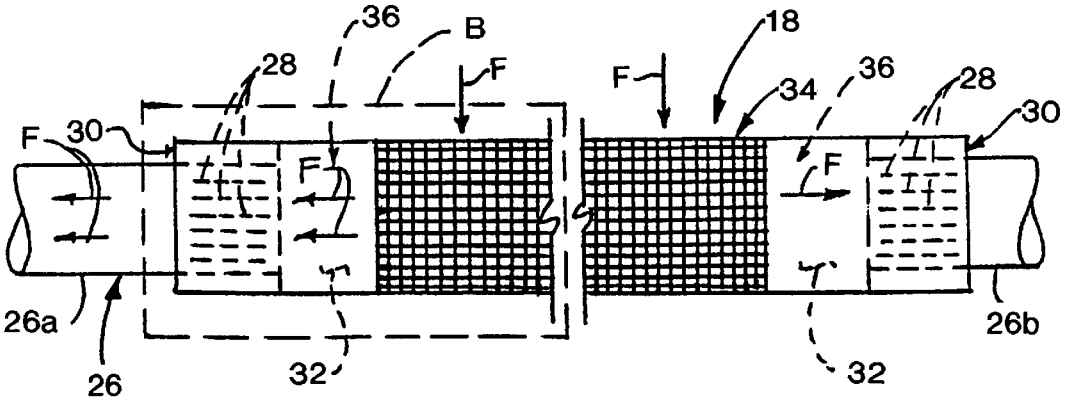
FIG. 2 is an enlarged scale, horizontally foreshortened schematic side elevational view of the drainage pipe section within the dashed line area "A" in FIG. 1.

Referring now to FIGS. 1 and 2, as subsequently described in greater detail herein, each drainage pipe section 18 basically comprises a tubular inner or base pipe 26 with opposite left and right end portions 26*a* and 26*b* in each of which is formed a circumferentially spaced series of axially extending fluid inlet slots 28. A tubular outer inlet flow structure 30 coaxially circumscribes the base pipe 26 and forms a flow passage 32 disposed between the base pipe 26 and the flow structure 30 and extending between the two sets of fluid inlet slots 28 as schematically depicted in FIG. 2. A longitudinally central portion of the tubular inlet flow structure 30 is defined by a fluid filtration structure, representatively a stainless steel wire wrapped sand screen assembly 34.

During operation of the well 10, pressurized production fluid F flows inwardly through the sand screen 34, which filters particulate matter from the production fluid, horizontally through the flow passage 32, inwardly through the two series of base pipe slots 28 into the interior of the base pipe 26, and then leftwardly through the base pipe 26 for delivery to the surface through the balance of the piping string 16.

According to a key feature of the present invention, production fluid inflow to the various drainage pipe sections 18 in the horizontal portion of the piping string 16 is substantially equalized, thereby tending to substantially maximize the production fluid retrieval from the well 10, using specially designed selectively variable length labyrinth structures 36 interposed in the passage 32 between the opposite ends of the sand screen assembly 34 and the two sets of base pipe fluid inlet slots 28. In each drainage pipe section 18 the labyrinth structures 36 serve as inlet control devices (ICD's) and, as subsequently described in detail herein, are provided with specially designed seal structures that also embody principles of the present invention and provide for substantially improved fluid inflow control accuracy in each drainage pipe section 18.

Figure 3:
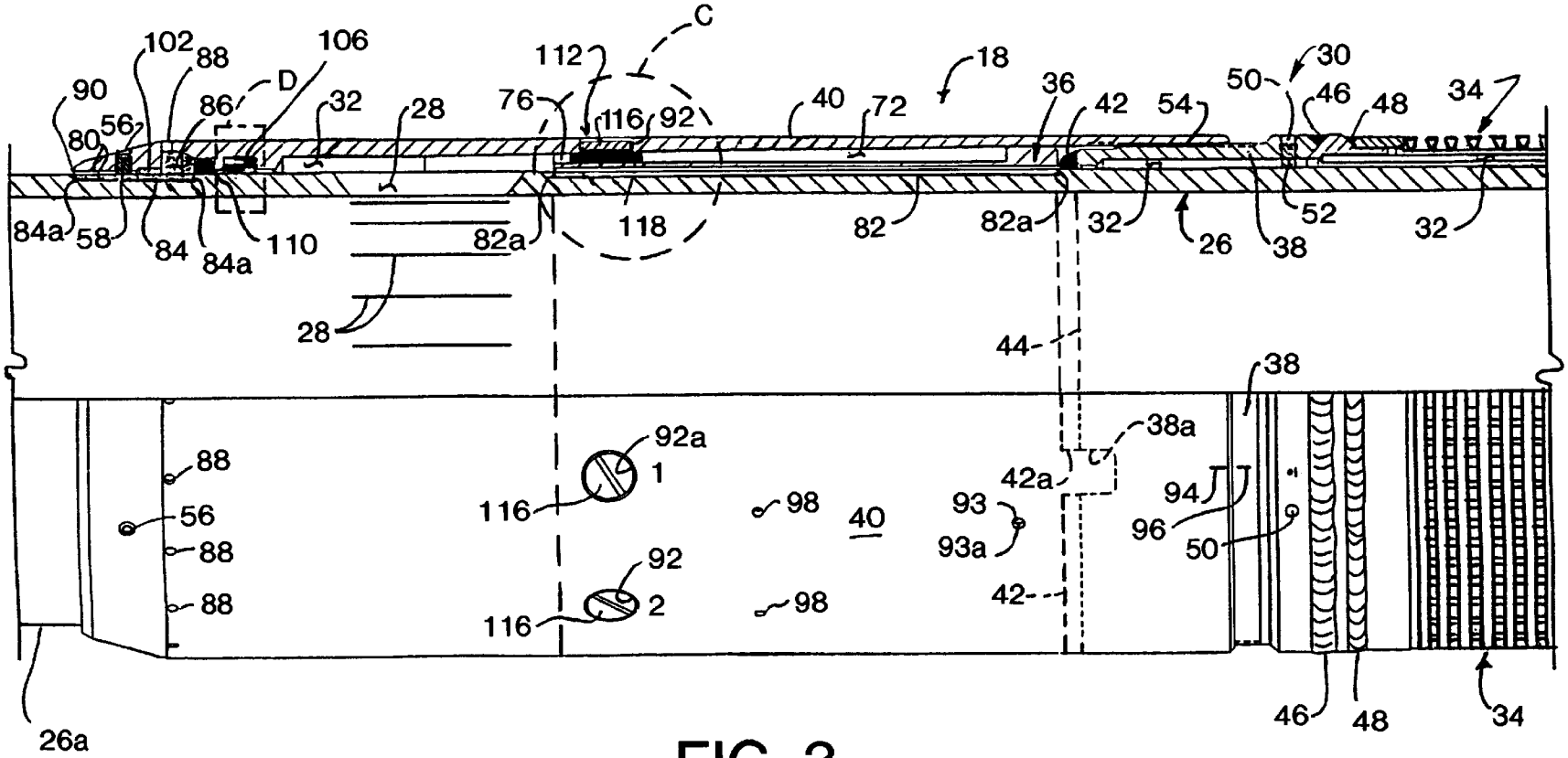
FIG. 3 is an enlarged scale quarter sectional view of the portion of the drainage pipe section within the dashed line area "B" in FIG. 2.

Referring now to FIG. 3, which illustrates in quarter section a left end portion of the drainage pipe section 18 depicted in schematic form in FIG. 2, the tubular outer inlet flow structure 30 that coaxially circumscribes the base pipe 26 and forms therewith the annular flow passage 32 includes, at each end of the tubular sand screen assembly 34, an annular screen connector member 38 and a tubular housing member 40. The left end portion of the drainage pipe section depicted in FIG. 3 is a mirror image of its right end portion.

The annular screen connector member 38 is secured at its left or axially outer end to the outer side of the base pipe 26 by an annular weld 42 having a circumferential gap 42*a* therein which is aligned with a longitudinally extending notch 38*a* formed in the left or axially outer end 44 of the connector member 38. The aligned weld gap 42*a* and connector member end notch 38*a* form a passage through which the portions of the annular flow passage 32 on the left and right sides of the weld 42 communicate. The right or axially inner end of the connector member 38 is anchored to the left end of the sand screen assembly 34 by means of two annular welds 46 and 48.

To provide for precise centering of the sand screen assembly 34 relative to the base pipe 26, thus providing for essentially uniform thicknesses of the portions of the passage 32 underlying the screen assembly 34 and the connector member 38, the connector member 38 is provided with a circumferentially spaced series of interiorly threaded circular openings 50 in which centering screws 52 are positioned (only one centering screw 52 being visible in FIG. 3). The inner ends of the centering screws 52 bear against the outer side of the base pipe 26 and may be loosened or tightened as necessary to provide the desired centering of the connector member 38, and thus the sand screen assembly 34, relative to the underlying base pipe 26.

A right or axially inner end portion of the tubular housing member 40 outwardly overlies the connector member 38 and is threadingly coupled thereto at threaded section 54 which has a suitable epoxy thread sealant compound applied thereto. A series of internally threaded circular openings 56 are formed in a left or axially outer end portion of the housing member 40. Centering screws 58 (only one of which is visible in FIG. 3) are threaded into the openings 56, bear against the outer side of the base pipe 26, and are used to center a left end portion of the housing member 40 relative to the base pipe 26 to thereby generally equalize the radial thickness of the portion of the annular passage 32 to the left of the annular weld 42.

Figure 8:
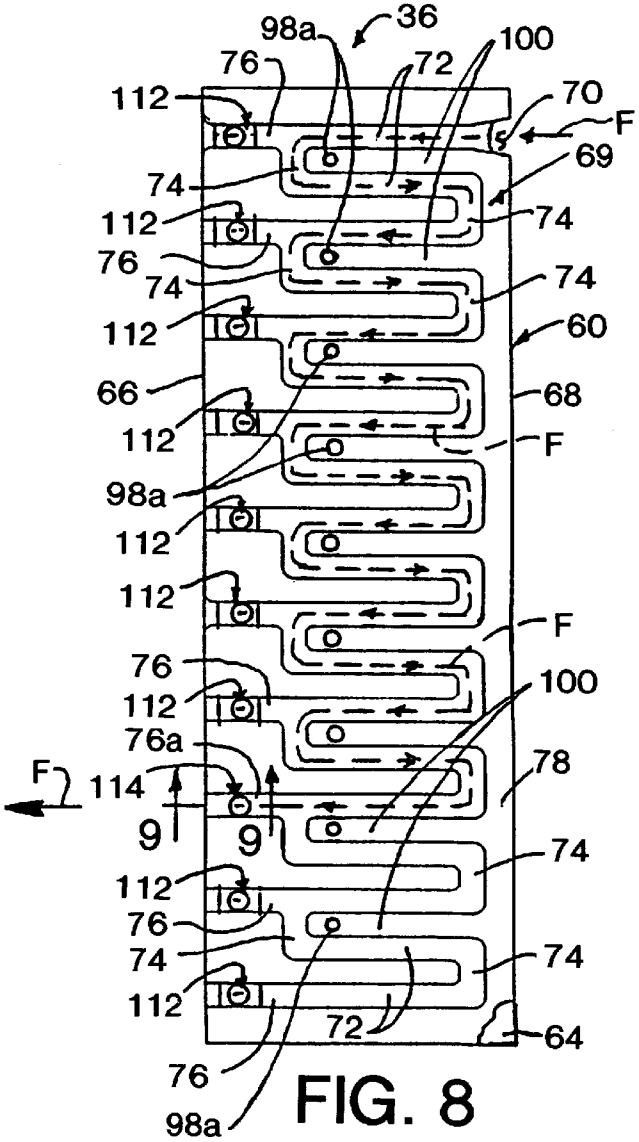
FIG. 8 is a reduced scale developed exterior side view of the labyrinth portion.
Figure 7:
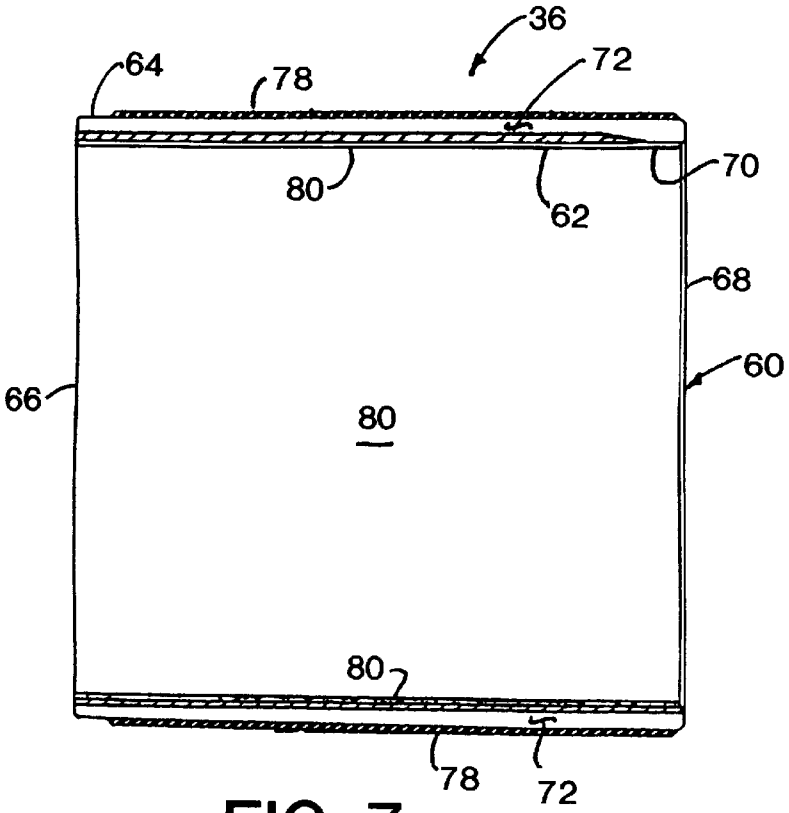
FIG. 7 is an enlarged scale cross-sectional view through a labyrinth portion of the inlet flow control structure of the present invention.

Referring now to FIGS. 3, 7 and 8, the labyrinth structure 36 has a hollow tubular metal body portion 60 with inner and outer side surfaces 62 and 64, an open left end 66, and an open right end 68. Body portion 60, as can best be seen in FIG. 7, tapers slightly in a leftward and radially inward direction. As best illustrated in FIG. 3, the labyrinth structure 36 coaxially circumscribes the base pipe 26 and is interposed in the annular flow passage 32 between the connector member 38 and the base pipe fluid inlet slots 28. A labyrinth flow passage 69 (see FIG. 8) is suitably recessed into the outer side surface 64 and has a single fluid inlet opening 70 extending inwardly through the right labyrinth structure body end 68. The labyrinth inlet opening 70 is circumferentially aligned with the weld gap 42*a* and the connector member notch 38*a* (see FIG. 3).

As viewed in FIG. 8, from its inlet opening 70 the labyrinth flow passage 69 has a downwardly serpentined configuration including a spaced series of axially extending passage portions 72 (representatively ten in number) interconnected at alternating end portions thereof by shorter circumferentially extending passage portions 74 as illustrated. Alternating ones of the passage portions 72 have axially extending outlet portions 76 that pass outwardly through the left end surface 66 of the labyrinth structure 36.

For sealing purposes later described herein, a thin coating of an elastomeric material 78, preferably rubber, is suitably adhered to the outer side surface 64 of the labyrinth structure body 60 (see FIG. 7). The rubber coating 78 does not extend into the labyrinth flow passage 69 and preferably has a thickness within the range of from about 0.008 inches to about 0.012 inches. Also for sealing purposes later described herein, a thin coating of sealant primer material 80 is applied to the inner side surface 62 of the labyrinth structure body 60. Preferably, the primer material 80 is an epoxy xylene material, such as that used in aerospace fuel tank applications, and has a thickness within the range of from about 0.001 inches to about 0.003 inches.

Figure 4:
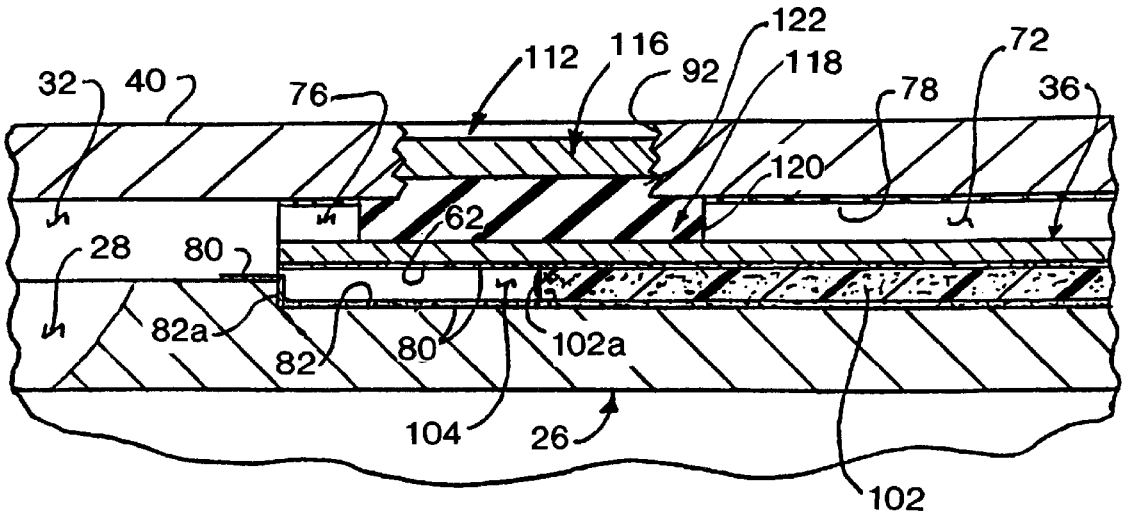
FIG. 4 is an enlarged scale detail view of the dashed line area "C" in FIG. 3.

Turning now to FIGS. 3 and 4, an annular exterior side surface primer recess 82 is formed on the base pipe 26. The primer recess 82 is in an aligned, facing relationship with the inner side surface 62 of the labyrinth structure 36 and has opposite ends 82*a*. A similar annular exterior side surface primer recess 84 is formed in the base pipe 26 in a facing relationship with a left or axially outer end portion of the housing member 40 in which the openings 56 and an annular interior side surface recess 86 are disposed. As best illustrated in FIG. 3, a circumferentially spaced series of small circular holes 88 extend radially inwardly through the tubular housing member 40 into the annular recess 86. The annular recess 86 opens outwardly through the left or axially outer end of the housing member 40 via a small annular gap 90 between the interior side surface of the left end of the housing member 40 and a left end portion of the primer recess 84.

As best illustrated in FIG. 4, a thin layer of the previously described primer material 80 is suitably adhered to the inner surface of the annular recess 82 and is also carried short distances past the recess ends 82*a* along the outer side surface of the base pipe 26. A thin layer of the primer material 80 is also suitably adhered to the inner surface of the annular recess 84 (see FIG. 3) as well as to the opposing annular interior surface portion of the housing member 40.

A circumferentially spaced series of internally threaded circular holes 92 (representatively ten in number) are formed in the tubular housing member 40 and, with the labyrinth structure 36 operatively positioned within the housing member 40, are circumferentially aligned with the labyrinth passage outlet portions 76 (see FIG. 8). Prior to the installation of the housing member 40 on the base pipe 26, and the threaded connection of the housing member 40 to the screen connector 38, the labyrinth structure 36 is leftwardly inserted into the open right end of the housing member 40. The proper insertion depth of the labyrinth structure 36 is automatically provided for by means of a slight interior surface tapering in a right longitudinal section of the housing member 40 which corresponds to the previously described exterior tapering of the labyrinth structure 36. The labyrinth structure 36 is diametrically sized relative to the housing member 40 in a manner such that upon insertion of the labyrinth structure 36 into the housing member 40 the rubber layer 78 on the exterior side surface of the labyrinth structure 36 is slightly compressed, thereby forming an essentially fluid tight seal between the outer side surface 64 of the labyrinth structure and the facing interior side surface portion of the surrounding housing member 40.

While the labyrinth structure 36 is being axially pressed into the housing member 40 a circumferentially spaced plurality of small circular openings 93 (only one of which is shown in FIG. 3) are drilled inwardly through the housing member 40 and partially into the inserted labyrinth structure 36, and retention pins 93*a* are forced into the holes 93*a* to thereby axially retain the pressed-in labyrinth structure 36 in place within the housing member 40 as illustrated in FIG. 3.

The proper relative circumferential orientation of the labyrinth structure 36 and the housing member 40, in which the labyrinth passage inlet 70 (see FIG. 8) is circumferentially aligned with the weld gap 42*a* and the screen connector member notch 38*a*, is achieved using alignment lines 94, 96 respectively scribed on adjacent exterior surface portions of the housing member 40 and the screen connector member 38. As the labyrinth structure 36 is being inserted into the housing member 40, the labyrinth structure is rotationally oriented relative to the housing member in a manner such that the inner end of an alignment stud (not shown) temporarily threaded into one of the circular openings 92, for example the opening 92*a* depicted in FIG. 3, enters the labyrinth passage portion 72,76 having the inlet opening 70 at one end thereof (i.e., the top passage portion 72,76 as viewed in FIG. 8).

The use of the alignment stud in this manner positions the installed labyrinth structure 36 in a predetermined circumferential relationship with the alignment mark 94 on the housing member 40. Alignment mark 94, in turn, is related to the alignment mark 96 on the screen connector member 38 in a manner such that, when the mark 94 is circumferentially aligned with the mark 96 as the housing member 40 is being threaded onto the screen connector member 38 the labyrinth inlet opening 70 (see FIG. 8) is circumferentially aligned with the weld gap 42*a* and the connector member end notch 38*a* (see FIG. 3).

With reference now to FIGS. 3, 4 and 8, a circumferentially spaced series of, representatively, ten small circular injection holes 98 are formed in the housing member 40 and are positioned around its circumference to overlie outer side surface areas 100 of the installed labyrinth structure 36 disposed between adjacent pairs of the labyrinth passage portions 72 as shown in FIG. 8. After the labyrinth structure 36 is installed between the base pipe 26 and the housing member 40 as previously described herein, the injection holes 98 are used as guides to drill underlying holes 98*a* radially inwardly through the labyrinth structure wall portions 100.

Subsequent to the formation of the holes 98*a*, predetermined quantities of an adhesive type resilient sealant material 102 (see FIG. 4) are injected inwardly through the aligned hole pairs 98,98*a* into the annular space 104 between the facing primed labyrinth structure and recess surfaces 62 and 82. Preferably, the sealant material 102 is a chemically curing polythioether polymer-based sealant material of the type used, for example, to seal aerospace industry fuel tank joints. The injected sealant material 102 forms a resilient annular seal between the inner side surface of the labyrinth structure 36 and the base pipe 26 which it coaxially circumscribes. The predetermined quantities of sealant 102 injected inwardly through the hole pairs 98,98*a* are selected in a manner such that the opposite ends of this resulting annular seal (such as the seal end 102*a* in FIG. 4) are spaced axially inwardly from the opposite ends 82*a* of the primer side surface recess 82.

Figure 12:
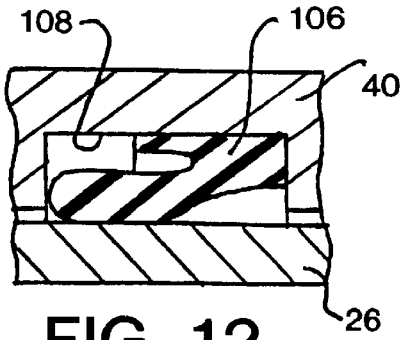
FIG. 12 is an enlarged scale detail view of the dashed line area "D" in FIG. 3.

In addition to the annular inner and outer seals 78 and 102 associated with the labyrinth structures 36 at the opposite ends of the drainage pipe section 18, the drainage pipe section 18 has, at the axially outer ends of its two tubular housing members 40 a specially designed nose seal structure. The nose seal structure shown at the left or axially outer end of the housing member 40 in FIG. 3 includes an annular elastomeric lip seal 106 (see also FIG. 12) having a generally C-shaped cross-section and being disposed in an annular interior side surface recess 108 in the housing member 40. As illustrated, the lip seal 106 is radially compressed between the outer side surface of the base pipe 26 and the inner side surface of recess 108.

The nose seal structure also includes a redundant elastomeric O-ring seal member 110 positioned between the lip seal 106 and the interior recess 86 and compressed between the interior side surface of the housing member 40 and the outer side surface of the base pipe 26. The final portion of the redundant nose seal structure is positioned just to the left of the O-ring seal 110 and consists of a quantity of the previously described adhesive sealant 102 injected inwardly through the circular holes 88 and filling the annular interior recess 86 and the leftwardly adjacent annular gap 90 between the left end of the housing member 40 and the facing outer side surface portion of the base pipe 26.

The effective length of the labyrinth flow passage 69 (see FIG. 8), and thus the total resistance to pressurized well fluid flow therethrough, may be selectively varied using specially designed plug structures 112 (see FIGS. 4–5C and 8) and 114 (see FIGS. 8–11) that embody principles of the present invention. In a manner subsequently described herein, the plug structures 112 are installed in all but a selected one of the labyrinth outlet passage portions 76 and serve to sealingly block such outlet passage portions and their overlying circular housing member plug holes 92. A plug structure 114 is installed in the remaining plug hole 92 and sealingly blocks it, but does not block the underlying labyrinth outlet passage portion 76*a*.

Accordingly, pressurized well fluid entering the labyrinth inlet 70 (see FIG. 8) flows through the labyrinth passage 69 until it reaches and is leftwardly discharged through the unblocked passage outlet portion 76*a* with the plug structure 114 in its associated housing member plug hole 92. As representatively shown in FIG. 8, the non-outlet blocking plug structure 114 is installed in the third outlet passage portion 76 from the bottom. Thus, the incoming pressurized well fluid F follows the dashed line flow path indicated in FIG. 8, exiting the labyrinth structure 36 through passage outlet portion 76*a*. By simply switching positions of the plug structure 114 and one of the plug structures 112 the actual length of the labyrinth passage 69 through which the well fluid F flows may be selectively shortened or lengthened to correspondingly reduce or increase the fluid pressure drop across the labyrinth structure 36.

Figure 5A:
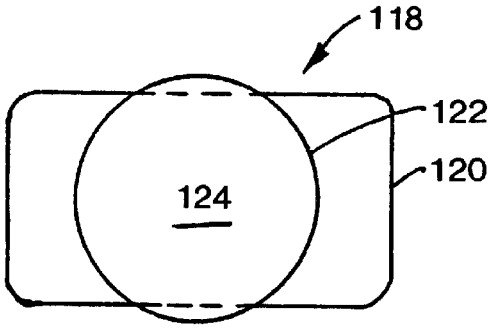
FIGS. 5A–5C, respectively, are top plan, side elevational and end elevational views of a resilient portion of a specially designed labyrinth passage closure structure embodying principles of the present invention and cross-sectionally illustrated in FIG. 4.
Figure 6:
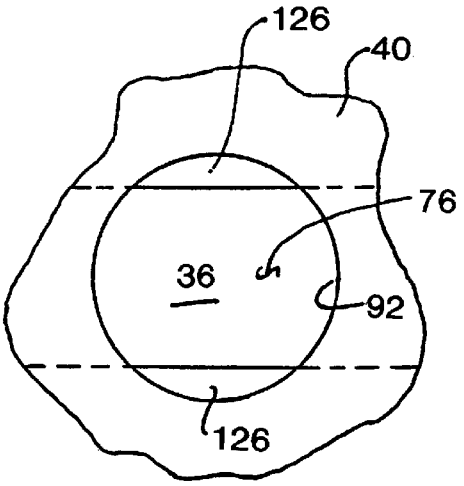
FIG. 6 is an outer side elevational view of outer housing opening with which the closure structure is operatively associated.
Figure 5B:
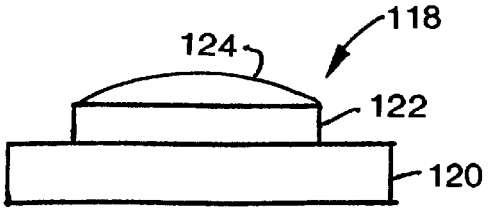
Figure 5C:
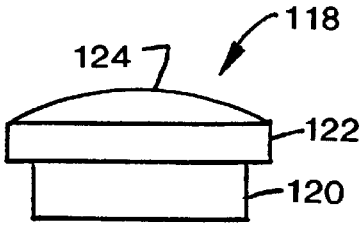

Turning now to FIGS. 4–6, each plug structure 112 includes a rigid portion 116 and an elastomeric sealing portion 118. Rigid portion 116 is a metal, exteriorly threaded disc which threads into the associated housing portion plug hole 92 from the outside of the housing portion 40. Elastomeric sealing portion 118 has an elongated rectangular base portion 120 sized to be complementarily received in its associated labyrinth outlet passage portion 76, and a generally disc-shaped top portion 122 having a domed upper side surface 124. As illustrated in FIG. 6, each housing member circular plug opening 92 has a diameter somewhat larger than the width of the underlying outlet passage portion 76, thereby exposing an opposite pair of ledge sections 126 of the labyrinth structure 36 at the bottom end of the hole 92.

Each resilient section 118 is installed by positioning its base portion 120 in the associated outlet passage portion 76, with the top portion 122 of the resilient section 118 extending upwardly into the overlying housing portion hole 92. Next, as best illustrated in FIG. 4, the rigid plug disc 116 is threadingly tightened into the associated housing member hole 92 until the disc 116 compresses the elastomeric plug structure portion 118 between the plug 116 and the inner side surface of the outlet passage portion 76. This compression of the elastomeric portion 118 causes the base portion 120 to be deformed into tight sealing engagement with the bottom and opposite side surfaces of the passage portion 76 and the inner side surface of the housing member 40, thereby sealingly blocking off the outlet passage portion 76. The compression of the elastomeric portion 118 also causes the top portion 122 to be deformed into sealing engagement with the interior side surface of the hole 92. Further sealing of the hole 92 is preferably effected using a suitable epoxy-type thread sealant on the disc 116.

Figure 9:
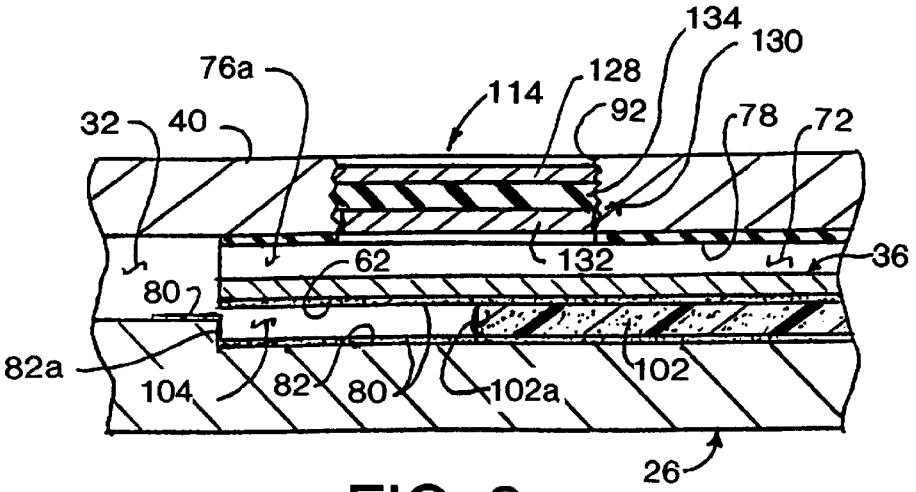
FIG. 9 is an enlarged scale cross-sectional view through the labyrinth portion taken along line 9—9 of FIG. 8 and illustrating a specially designed housing opening closure plug structure installed in the screened drainage piping section outwardly of one of the labyrinth flow passages.
Figure 10:
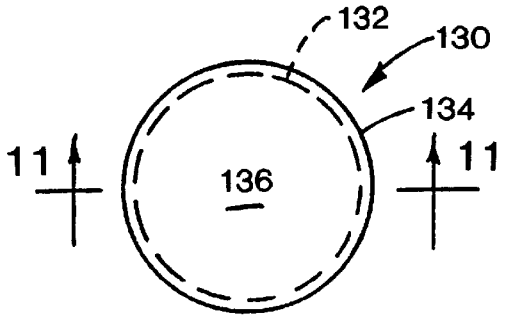
FIG. 10 is a top plan view of a sealing disc portion of the closure plug structure.
Figure 11:
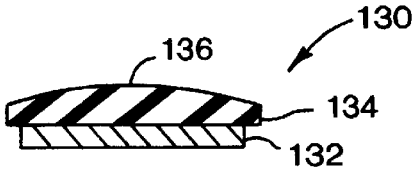
FIG. 11 is a cross-sectional view through the sealing disc portion taken along line 11—11 of FIG. 10.

Turning now to FIGS. 9–11, the plug structure 114 includes an externally threaded metal disc 128 (similar to the previously described discs 116) threadable into the housing member hole 92 overlying the labyrinth outlet passage portion 76*a* (see FIG. 9), and a sealing structure 130 having a metal, disc-shaped base portion 132 sized to be inserted inwardly through the hole 92 and rest on the underlying ledges 126 (see FIG. 6), and a slightly larger diameter disc-shaped elastomeric upper side portion 134 having a domed top side surface 136. With the sealing structure operatively placed within the housing member hole 92 that overlies the outlet passage portion 76*a*, the disc 128 is threaded into the hole 92 and firmly tightened against the underlying sealing structure 130. This compresses the elastomeric portion 134 between the disc 128 and the disc 132 and outwardly deforms the elastomeric portion 134 into tight sealing engagement with the interior side surface of the hole 92.

As is best illustrated in FIG. 9, the installed plug structure 114, while it tightly seals off its housing member hole 92 it does not extend downwardly into or block any portion of the underlying labyrinth outlet passage portion 76*a*. Accordingly, the well fluid traversing the labyrinth passage 69 can freely exit it via the outlet passage portion 76*a*. The sealing of the hole 92 by the plug structure 114 is augmented by using an epoxy-type thread sealant on the disc 128.

The various specially designed sealing structures incorporated in the illustrated drainage pipe section 18 serve to advantageously assure that essentially all of the well fluid which enters the interior of the base pipe 26 via its various fluid inlet openings 28 operatively traverses the sand screen assembly 34 as well as the selected fluid flow length of the labyrinth passage 36 and does not undesirably bypass either the screen structure or any portion of the selected labyrinth passage length.

Specifically, as described above, the redundant nose seal structures at the axially outer ends of the tubular housing members 40 prevent any appreciable amount of pressurized well fluid from flowing inwardly beneath the outer ends of the housing members into the passage 32 (see FIG. 3) and undesirably bypassing the labyrinth structures 36 on its way into the interior of the base pipe 26 through its sidewall openings 28. Plug structures 112,114 serve to prevent any appreciable amount of pressurized well fluid from entering the interior of the housing members 40, via the plug holes 92, and undesirably flowing through only a portion of the intended labyrinth flow passage length.

The sealant materials 78 and 102 respectively disposed on the outer and inner side surfaces of the labyrinth structure 36 (see FIGS. 4 and 7) assures that no appreciable portion of the pressurized well fluid approaching the labyrinth inlet 70 in the annular passage 32 axially traverses the labyrinth structure 36 without passing through the entire selected length of its labyrinth passage 69. By virtue of this highly efficient overall sealing apparatus, the fluid flow regulation accuracy of each of the drainage pipe sections is substantially increased, thereby permitting the fluid inflow rates thereof to be more accurately equalized to correspondingly provide for heightened well fluid production rates.

The foregoing detailed description is to be clearly understood as being given by way of illustration and example only, the spirit and scope of the present invention being limited solely by the appended claims.

What is claimed is:

1. Production fluid drainage apparatus for a subterranean well, comprising:

a base pipe having a sidewall inlet opening therein;

a tubular structure coaxially circumscribing the base pipe and forming therewith an annular fluid flow passage communicating with the interior of the base pipe through the sidewall inlet opening, the tubular structure having a fluid filtering section axially offset from the sidewall inlet opening and through which well fluid may flow into the annular fluid flow passage; and an adjustable fluid flow control structure operative to selectively vary well fluid inflow through the fluid filtering section into the base pipe and including (1) an annular flow control member coaxially circumscribing the base pipe and interposed in the fluid flow passage between the sidewall inlet opening and the fluid filtering section, the flow control member having an outer side surface and further having a selectively variable length flow passage for permitting well fluid to axially traverse the flow control member, and (2) a first resilient sealing material adhered to the outer side surface of the annular flow control member and being compressed between the flow control member and the tubular structure.

2. The production fluid drainage apparatus of claim 1 wherein:

the first resilient sealing material is an elastomeric material.

3. The production fluid drainage apparatus of claim 2 wherein:

the elastomeric material is rubber.

4. The production fluid drainage apparatus of claim 1 wherein:

the variable length flow passage is a labyrinth passage recessed into the outer side surface of the annular flow control member, and the first resilient sealing material is disposed only on the nonrecessed portions of the outer side surface of the annular flow control member.

5. The production fluid drainage apparatus of claim 1 wherein:

the outer side surface of the annular flow control member and a facing annular interior surface portion of the tubular structure have parallel conical tapers.

6. The production fluid drainage apparatus of claim 1 wherein:

the fluid filtering section includes a tubular sand screen assembly.

7. The production fluid drainage apparatus of claim 1 wherein the adjustable fluid flow control structure further includes:

a second resilient sealing material interposed and forming an annular resilient seal between the flow control member and the base pipe.

8. The production fluid drainage apparatus of claim 7 wherein:

the second resilient sealing material is an adhesive type resilient sealant material.

9. The production fluid drainage apparatus of claim 8 wherein:

the adhesive type resilient sealant material is a chemically curing polythioether polymer-based sealant material.

10. The production fluid drainage apparatus of claim 8 wherein:

the base pipe has an annular outer side surface depression facing an inner side surface portion of the annular flow control member, and the adhesive type resilient sealant material extends into the outer side surface depression.

11. The production fluid drainage apparatus of claim 10 wherein:

the inner side surface portion of the annular flow control member and the surface of the depression have a primer material thereon.

12. The production fluid drainage apparatus of claim 11 wherein:

the primer material is an epoxy xylene material.

13. The production fluid drainage apparatus of claim 1 further comprising:

adjustable apparatus for radially centering the base pipe and the tubular structure relative to one another.

14. The production fluid drainage apparatus of claim 13 wherein the adjustable apparatus includes:

first and second axially spaced apart series of circumferentially spaced internally threaded sidewall openings formed in the tubular structure, and a series of adjustment members threadingly received in the internally threaded sidewall openings and bearing against the base pipe.

15. Production fluid drainage apparatus for a subterranean well, comprising:

a base pipe having a sidewall inlet opening therein;

a tubular structure coaxially circumscribing the base pipe and forming therewith an annular fluid flow passage communicating with the interior of the base pipe through the sidewall inlet opening, the tubular structure having a fluid filtering section axially offset from the sidewall inlet opening and through which well fluid may flow into the annular fluid flow passage; and an adjustable fluid flow control structure operative to selectively vary well fluid inflow through the fluid filtering section into the base pipe and including (1) an annular flow control member coaxially circumscribing the base pipe and interposed in the fluid flow passage between the sidewall inlet opening and the fluid filtering section, the flow control member having an inner side surface and further having a selectively variable length flow passage for permitting well fluid to axially traverse the flow control member, and (2) an adhesive type resilient sealant material interposed and forming an annular resilient seal between the flow control member and the base pipe.

16. The production fluid drainage apparatus of claim 15 wherein:

the adhesive type resilient sealant material is a chemically curing polythioether polymer-based sealant material.

17. The production fluid drainage apparatus of claim 15 wherein:

the base pipe has an annular outer side surface depression facing an inner side surface portion of the annular flow control member, and the adhesive type resilient sealant material extends into the outer side surface depression.

18. The production fluid drainage apparatus of claim 17 wherein:

the inner side surface portion of the annular flow control member and the surface of the depression have a primer material thereon.

19. The production fluid drainage apparatus of claim 18 wherein:

the primer material is an epoxy xylene material.

20. The production fluid drainage apparatus of claim 15 further comprising:

adjustable apparatus for radially centering the base pipe and the tubular structure relative to one another.

21. The production fluid drainage apparatus of claim 20 wherein the adjustable apparatus includes:

first and second axially spaced apart series of circumferentially spaced internally threaded sidewall openings formed in the tubular structure, and a series of adjustment members threadingly received in the internally threaded sidewall openings and bearing against the base pipe.

22. Production fluid drainage apparatus for a subterranean well, comprising:

a base pipe having a sidewall inlet opening therein;

a tubular structure coaxially circumscribing the base pipe and forming therewith an annular fluid flow passage communicating with the interior of the base pipe through the sidewall inlet opening, the tubular structure having a fluid filtering section axially offset from the sidewall inlet opening and through which well fluid may flow into the annular fluid flow passage; and an adjustable fluid flow control structure operative to selectively vary well fluid inflow through the fluid filtering section into the base pipe and including:

an annular flow control member coaxially circumscribing the base pipe and interposed in the fluid flow passage between the sidewall inlet opening and the fluid filtering section, the flow control member having an outer side surface into which a labyrinth flow passage, through which pressurized well fluid may axially traverse the flow control member, is recessed, the labyrinth flow passage having a plurality of outlet portions spaced apart along its length which may be selectively blocked to correspondingly vary the fluid flow length of the labyrinth flow passage, a spaced series of plug openings extending through the tubular structure in overlying alignment with the labyrinth flow passage outlet portions, and a series of first plug structures operative to sealingly block selected ones of the labyrinth flow passage outlet portions, each first plug structure having (1) a resilient portion with a first section positionable in one of the labyrinth flow passage outlet portion, and a second section positionable in the overlying plug opening, and (2) a rigid portion securable in the overlying plug opening in forcible engagement with the second resilient section in a manner deforming the resilient portion into a sealingly blocking relationship with its associated plug opening and labyrinth flow passage outlet portion.

23. The production fluid drainage apparatus of claim 22 wherein:

the first section of each resilient plug structure portion has a rectangular configuration, and the second section of each resilient plug structure portion projects outwardly from the first section and has a cylindrical configuration.

24. The production fluid drainage apparatus of claim 23 wherein:

each second section has a domed outer end surface.

25. The production fluid drainage apparatus of claim 22 wherein:

each rigid plug structure portion has a generally disc-like configuration and is threadable into its associated plug opening.

26. The production fluid drainage apparatus of claim 22 further comprising:

a second plug structure operative to sealingly block one of the plug openings with appreciably encroaching on its underlying labyrinth flow passage outlet portion.

27. The production fluid drainage apparatus of claim 26 wherein:

each labyrinth flow passage outlet portion has, on opposite sides thereof, a pair of ledge surfaces exposed at the inner end of the overlying plug opening, and the second plug structure has (1) a first disc-shaped rigid portion configured to be received in the plug opening and rest on the ledges, the first disc-shaped rigid portion having an outer side, (2) a generally disc-shaped resilient portion having an inner side coaxially secured to the outer side of the first disc-shaped rigid portion, and (3) a second disc-shaped rigid portion threadable into the overlying plug opening into forcible engagement with the resilient portion to deform it into sealing engagement with an interior side surface portion of the overlying plug opening.

28. The production fluid drainage apparatus of claim 27 wherein:

the resilient portion has a diameter larger than that of the first disc-shaped rigid portion.

29. The production fluid drainage apparatus of claim 27 wherein:

the resilient portion has a domed outer side surface.

30. An inlet flow control device for a well fluid drainage pipe section, comprising:

an annular body member having an outer side surface, an inner side surface, an inlet end, an outlet end, and a well fluid flow passage recessed into the outer side surface, the well fluid flow passage having an inlet portion extending inwardly from the inlet end of the body member, a labyrinth portion communicating with the inlet portion and extending circumferentially around the annular body member, and a circumferentially spaced series of outlet portions extending axially outwardly from the labyrinth portion through the outlet end of the annular body member; and a layer of resilient sealing material secured to essentially the entire nonrecessed portion of the outer side surface of the annular body member.

31. The inlet flow control device of claim 30 wherein:

the resilient sealing material is an elastomeric material.

32. The inlet flow control device of claim 31 wherein:

the resilient sealant material is rubber.

33. The inlet flow control device of claim 30 wherein:

the thickness of the layer of resilient sealing material is within the range of from about 0.008 inches to about 0.012 inches.

34. The inlet flow control device of claim 30 wherein:

the annular body member has an axial notch formed in its inlet end and extending into the inlet portion of the well fluid flow passage.

35. The inlet flow control device of claim 30 wherein:

the annular body member conically tapers inwardly toward the outlet end thereof.

36. Production fluid drainage apparatus for a subterranean well, comprising:

a base pipe having a sidewall inlet opening therein;

a tubular structure coaxially circumscribing the base pipe and forming therewith an annular fluid flow passage communicating with the interior of the base pipe through the sidewall inlet opening, the tubular structure having a fluid filtering section axially offset from the sidewall inlet opening and through which well fluid may flow into the annular fluid flow passage, and an axially outer end portion forming between itself and the base pipe an annular gap disposed axially outwardly of the base pipe sidewall inlet opening and through which the annular fluid flow passage outwardly opens;

an adjustable fluid flow control structure operative to selectively vary well fluid inflow through the fluid filtering section into the base pipe and including a flow control member coaxially interposed in the fluid flow passage between the sidewall inlet opening and the fluid filtering section; and seal apparatus disposed axially outwardly of the base pipe sidewall opening and being operative to essentially prevent pressurized well fluid from entering the annular fluid flow passage through the annular gap, the seal apparatus including:

an annular interior side surface recess disposed axially inwardly of the annular gap and defining a radial enlargement thereof, and a quantity of an adhesive type resilient sealant material filling the interior side surface recess and extending therefrom into the annular gap.

37. The production fluid drainage apparatus of claim 36 wherein:

the adhesive type resilient sealant material is a chemically curing polythioether polymer-based sealant material.

38. The production fluid drainage apparatus of claim 36 wherein:

the base pipe has an annular outer side surface depression facing the annular gap and the annular side surface recess, and the adhesive type resilient sealant material extends into the outer side surface depression.

39. The production fluid drainage apparatus of claim 38 wherein:

the surface of the annular depression and an opposing annular interior side surface portion of the tubular structure have a primer material thereon.

40. The production fluid drainage apparatus of claim 39 wherein:

the primer material is an epoxy xylene material.

41. The production fluid drainage apparatus of claim 36 further comprising:

adjustable apparatus for radially centering the base pipe and the tubular structure relative to one another.

42. The production fluid drainage apparatus of claim 36 wherein:

a circumferentially spaced series of internally threaded sidewall openings formed in the axially outer end portion of the tubular structure, and a series of adjustment members threadingly received in the internally threaded sidewall openings and bearing against the base pipe.

43. The production fluid drainage apparatus of claim 36 wherein the seal apparatus further includes:

an annular interior side surface groove formed in the axially outer end portion of the tubular structure axially inwardly of the annular interior side surface recess, and an annular resilient lip seal member having a generally C-shaped cross-section, the lip seal member being received in the side surface groove and being compressed between the tubular structure and the base pipe.

44. The production fluid drainage apparatus of claim 43 wherein the seal apparatus further includes:

an annular resilient O-ring seal circumscribing the base pipe between the annular interior side surface recess and the lip seal member and being compressed between the tubular structure and the base pipe.

45. A method of constructing a drainage pipe section for a subterranean well, the method comprising the steps of:

providing a base pipe having a sidewall fluid inlet opening therein;

coaxially positioning a tubular structure around the base pipe to form therebetween an annular passage that communicates with the interior of the base pipe through its sidewall fluid inlet opening;

coaxially positioning an annular flow control member in the annular passage in an axially offset relationship with the sidewall fluid inlet opening, the positioned tubular structure and flow control member being relatively configured in a manner creating an annular gap therebetween;

forming a circumferentially spaced series of radially extending holes inwardly through the tubular structure and the flow control member into the annular gap; and injecting an adhesive type resilient sealant material inwardly through the holes into the annular gap in a manner forming therein a continuous annular resilient seal structure radially extending between facing surface portions of the base pipe and flow control member.

46. The method of claim 45 wherein:

the injecting step is performed utilizing a chemically curing polythioether polymer-based sealant material.

47. A method of constructing a drainage pipe section for a subterranean well, the method comprising the steps of:

providing a base pipe having a sidewall fluid inlet opening therein;

coaxially positioning a tubular structure around the base pipe to form therebetween an annular passage that communicates with the interior of the base pipe through its sidewall fluid inlet opening, the positioned tubular structure having an axially outer end portion disposed axially outwardly of the sidewall fluid inlet opening and forming an annular gap between itself a facing portion of the base pipe;

coaxially positioning an annular flow control member in the annular passage in an axially inwardly offset relationship with the sidewall fluid inlet opening; and forming an essentially fluid tight seal between the axially outer end portion of the tubular structure and the facing portion of the base pipe by (1) forming in the axially outer end portion of the tubular structure an annular interior side surface recess which is positioned axially inwardly of and defines a radial enlargement of the annular gap, (2) forming an injection opening in the tubular structure that extends into the annular interior side surface recess, and (3) forcing an adhesive type sealant material inwardly through the injection opening in a manner causing the sealant material to fill the annular interior side surface recess and flow into and fill at least a portion of the annular gap.

48. The method of claim 47 wherein:

the forming step is performed using a chemically curing polythioether polymer-based sealant material.

* * * * *